US005142894A

United States Patent [19]

Gutowski

[11] Patent Number: 5,142,894

[45] Date of Patent: Sep. 1, 1992

[54] ROLL-FORMING METHOD

[75] Inventor: Timothy A. Gutowski, Spring Lake, Mich.

[73] Assignee: Contour Roll Company, Grand Haven, Mich.

[21] Appl. No.: 670,241

[22] Filed: Mar. 15, 1991

[51] Int. Cl.[5] ..... B21D 5/08

[52] U.S. Cl. ..... 72/129; 72/181; 72/176; 83/428

[58] Field of Search ..... 72/181, 179, 176, 129, 72/178; 83/428, 430, 426, 565, 39

[56] References Cited

U.S. PATENT DOCUMENTS

| | | | |
|---|---|---|---|
| 12,133 | 1/1855 | Kroehl . | |
| 282,919 | 8/1883 | Phelan . | |
| 709,754 | 9/1902 | Ditchfield | 72/181 |
| 2,339,355 | 1/1944 | Rutten | 72/181 |
| 2,497,043 | 2/1950 | Gerts | 72/176 |
| 3,051,214 | 8/1962 | Rutten | 72/181 |
| 3,499,305 | 5/1967 | Abernathy . | |
| 3,765,211 | 10/1973 | Struss | 72/181 |
| 3,779,062 | 12/1973 | Gegick . | |
| 3,824,828 | 7/1974 | Billows | 72/181 |
| 4,237,715 | 12/1980 | Lutz . | |
| 4,285,222 | 8/1981 | Jagelid . | |
| 4,287,742 | 9/1981 | Heiman | 72/181 |
| 4,475,422 | 10/1984 | Lawson | 83/428 |
| 4,558,577 | 12/1985 | Trishevsky et al. . | |

FOREIGN PATENT DOCUMENTS

| | | | |
|---|---|---|---|
| 161213 | 9/1984 | Japan | 83/428 |

*Primary Examiner*—Daniel C. Crane

*Attorney, Agent, or Firm*—Price, Heneveld, Cooper, DeWitt & Litton

[57] ABSTRACT

A method and apparatus is provided for making three-dimensional metal parts with complex shapes such as skis, automotive trim, and other like elongated parts. The method includes uncoiling an cutting off segments of coiled stock to form a part blank, and mounting the part blank on an elongated jig with opposite sides of the part blank extending outwardly from the jig. The method further includes the steps of slitting the part blank to a predetermined symmetrical but non-uniform width by passing the jig past slitting heads, and roll-forming the slit blank in a similar manner. In the preferred embodiment, the method also includes controlling the vertical rotation of the slitting heads and the roll-forming heads. The apparatus includes a machine for making three-dimensional articles having complex non-uniform lateral cross-sectional shapes along the length thereof. The machine includes slitting heads and/or roll-forming heads adapted to laterally converge and diverge and also rotate about vertical axes. The heads are positioned in a laterally spaced apart relationship to receive a part blank holding jig so that the heads slit and form the blank as the jig is translated past the heads. The lateral and vertical rotating movement of the heads in controlled to assist in shaping the part.

23 Claims, 9 Drawing Sheets

ROLL-FORMING METHOD

BACKGROUND OF THE INVENTION

The present invention relates to forming machines, and in particular to a machine for slitting and roll-forming a non-uniform shape.

Roll-forming is used extensively to form elongated parts having uniform cross-sections Due to the efficiencies of roll-forming, efforts have been made to expand the use of roll-forming to elongated parts having non-uniform shapes. However, these efforts have met with varying degrees of success. Typically, the roll-forming machines capable of rolling non-uniform shapes tend to be complex and require significant set up time. This makes them less attractive for use in low volume runs, since adjustments are more difficult and time consuming. Further, the machines are more expensive. Still further, the position of the blank being formed is not positively controlled, thus leading to wandering of the blank and repeatability problems.

Shearing of non-uniform shapes to be roll-formed can also be problematic. Stamping dies for cutting blanks and the presses to run them are expensive and require frequent maintenance, particularly where high strength steels and alloys are used. Further, use of stamping dies necessitates a pool of inventory ahead of the roll-forming operation. In addition, there are problems of double handling of blanks and dimensional inconsistency which cause quality problems Still further, it is not practical or cost effective to stamp elongated blanks having opposing non-parallel and non-uniform edges, particularly where the blanks are made of high strength alloys.

The methods and apparatus for shaping complex elongated shapes are also inadequate. Typically for lower volume runs, the various steps required are carried out on separate machines in a discontinuous manner. This leads to poor in-process material flow, undesirable high in-process inventory, excessive handling damage, and generally poor process control.

Therefore, improvements in methods and equipment flexibility are desirable.

SUMMARY OF THE INVENTION

One aspect of the present invention is a method for making three-dimensional metal parts with complex shapes. The method includes uncoiling and straightening a segment of coiled strip stock, and cutting the segment to a predetermined length to define a part blank. The method further includes mounting the part blank generally centrally in a jig, such that the opposite sides of the part blank extend outwardly from the jig, and then sequentially slitting and roll-forming the opposite sides of the jig mounted part blank to form a complex, three-dimensional shape.

Another aspect of the present invention is a method for roll-forming three-dimensional metal parts with complex shapes. The method includes mounting a blank generally centrally in a jig such that opposite sides of the blank extend outwardly from the jig, and translating the jig mounted blank longitudinally past roll-forming heads to create a pair of upstanding flanges thereon, while simultaneously vertically rotating and laterally converging and diverging the roll-forming heads to assist in forming the flanges.

Yet another aspect of the present invention is a method of making two-dimensional metal parts with elongated shapes having a non-uniform width. The method includes mounting a blank generally centrally in a jig, such that opposite sides of the blank extend outwardly from the jig, and translating the jig mounted blank longitudinally past slitting heads to form a slit blank with a predetermined non-uniform width having symmetrical opposite side edges thereon while simultaneously vertically rotating and laterally converging and diverging the slitting heads to assist in shaping the blank.

Yet another aspect of the present invention is a machine for making three-dimensional metal parts with complex shapes. The machine includes a machine frame, and roll-forming heads connected with the machine frame and positioned in a laterally spaced apart relationship to define therebetween a path of translation for an elongate workpiece. The machine includes means for translating the workpiece longitudinally along the path, and means for movably mounting the roll-forming heads to laterally converge and diverge and also rotate about an associated vertical axis. The machine further includes means for actuating the roll-forming heads, such that as the workpiece is translated, the roll-forming heads are moved laterally and simultaneously vertically rotated to form along opposite sides of the workpiece upturned flanges with non-uniform heights.

Yet another aspect of the present invention is a machine for making slit blanks having non-uniform lateral edges along the length thereof. The machine includes a machine frame, and slitting heads connected with the machine frame and positioned in a laterally spaced apart relationship to define therebetween a path of translation for an elongate workpiece. The machine includes a mechanism for translating the workpiece longitudinally along the path, and for movably mounting the slitting heads to laterally converge and diverge and also rotate about an associated vertical axis. The machine further includes a mechanism for actuating the slitting heads, such that as the workpiece is translated, the slitting heads are selectively moved laterally and simultaneously vertically rotated to slit opposite side edges of the workpiece to form a slit blank of predetermined non-uniform width which is symmetrical to the central longitudinal axis of the jig.

Another aspect of the present invention is a machine for making three-dimensional articles having a non-uniform lateral cross-sectional shape along the length thereof. The machine combines the slitting and roll-forming machines noted above without the need to remove the workpiece from the machine.

DETAILED DESCRIPTION OF THE PREFERRED EMBODIMENTS

Figure 1:
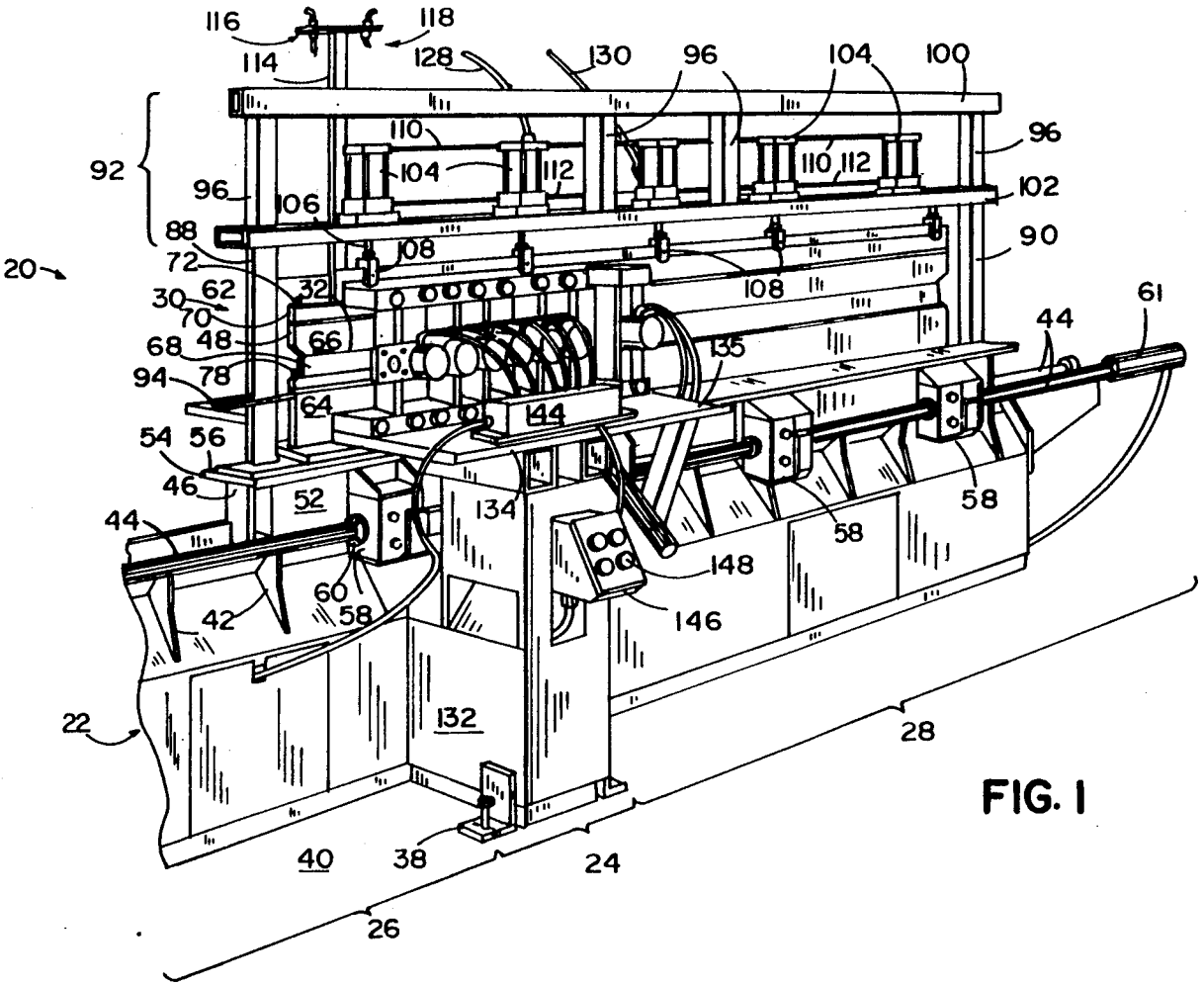
FIG. 1 is a perspective view of a machine embodying the present invention with one end partially broken away and the blank holding jig shown as translated part-way through the forming and slitting stations of the machine.
Figure 1A:
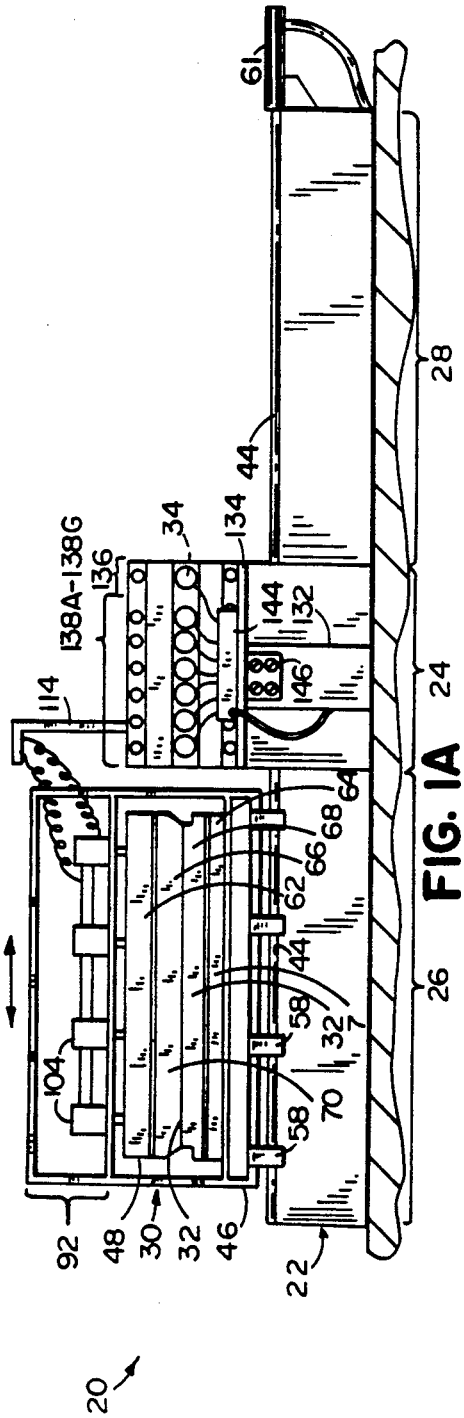
FIG. 1A is a schematic showing the general layout of the machine in FIG. 1 but with the blank holding jig assembly moved to an end thereof.

Referring now specifically to the drawings and the embodiments illustrated therein, a machine 20 (FIG. 1 and 1*a*) embodying the present invention includes a machine base or frame 22 which is elongated and generally box-like in shape. Frame 22 includes a central portion 24 and two laterally extending side portions 26 and 28. Frame 22 is constructed to support a blank holding fixture or jig assembly 30 as it translates between side portions 26 and 28 through central portion 24. Central portion 24 includes slitting or shearing heads 34 and roll-forming heads 36A–36G which slit and form a part blank or article 32 in jig assembly 30 as it translates through central portion 34, thereby providing a unique apparatus for forming three-dimensional parts with complex shapes.

Figure 2:
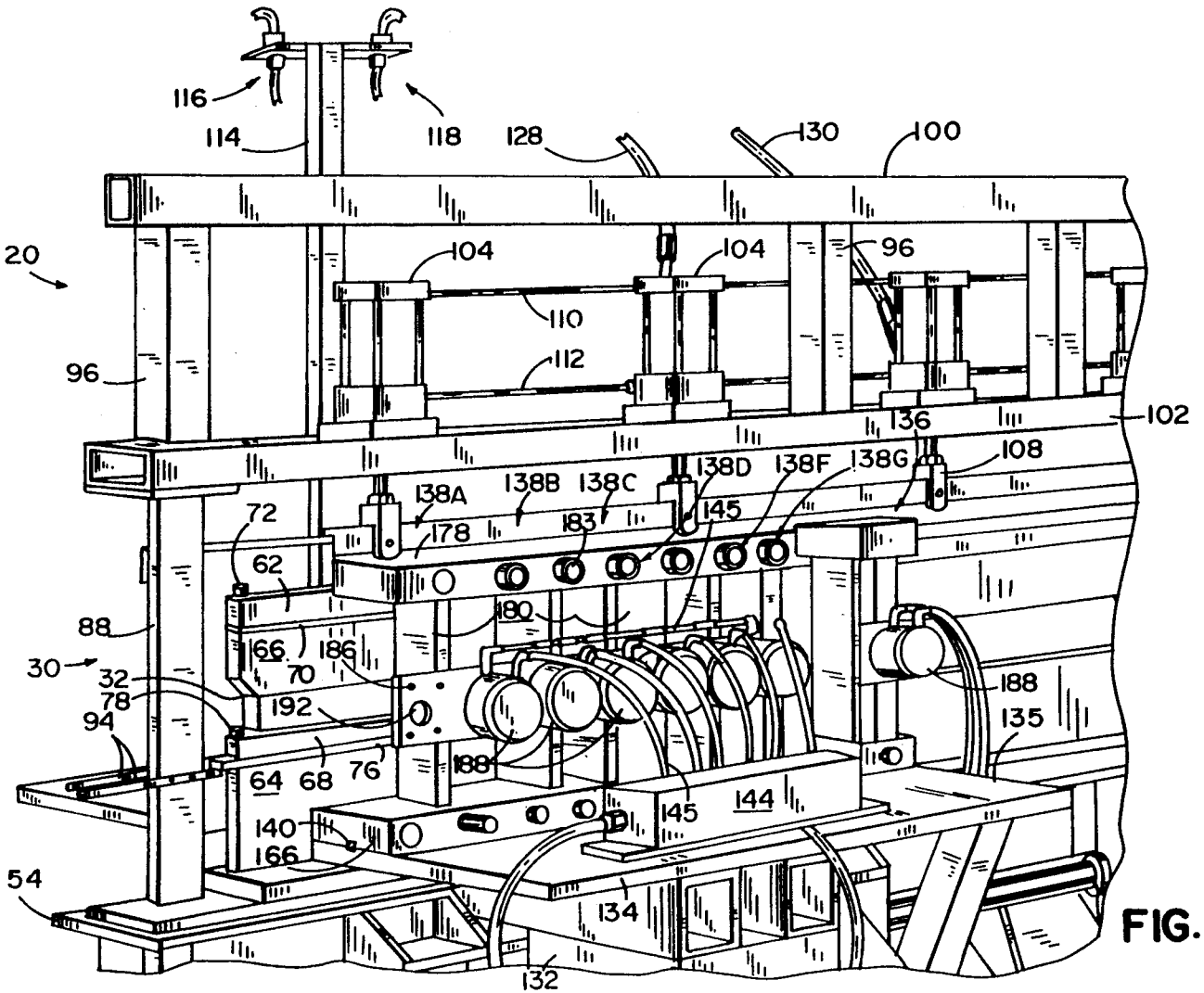
FIG. 2 is an enlarged perspective view of the forming and slitting stations shown in FIG. 1 with one of the roll-forming stations left unoccupied for illustration purposes.
Figure 3:
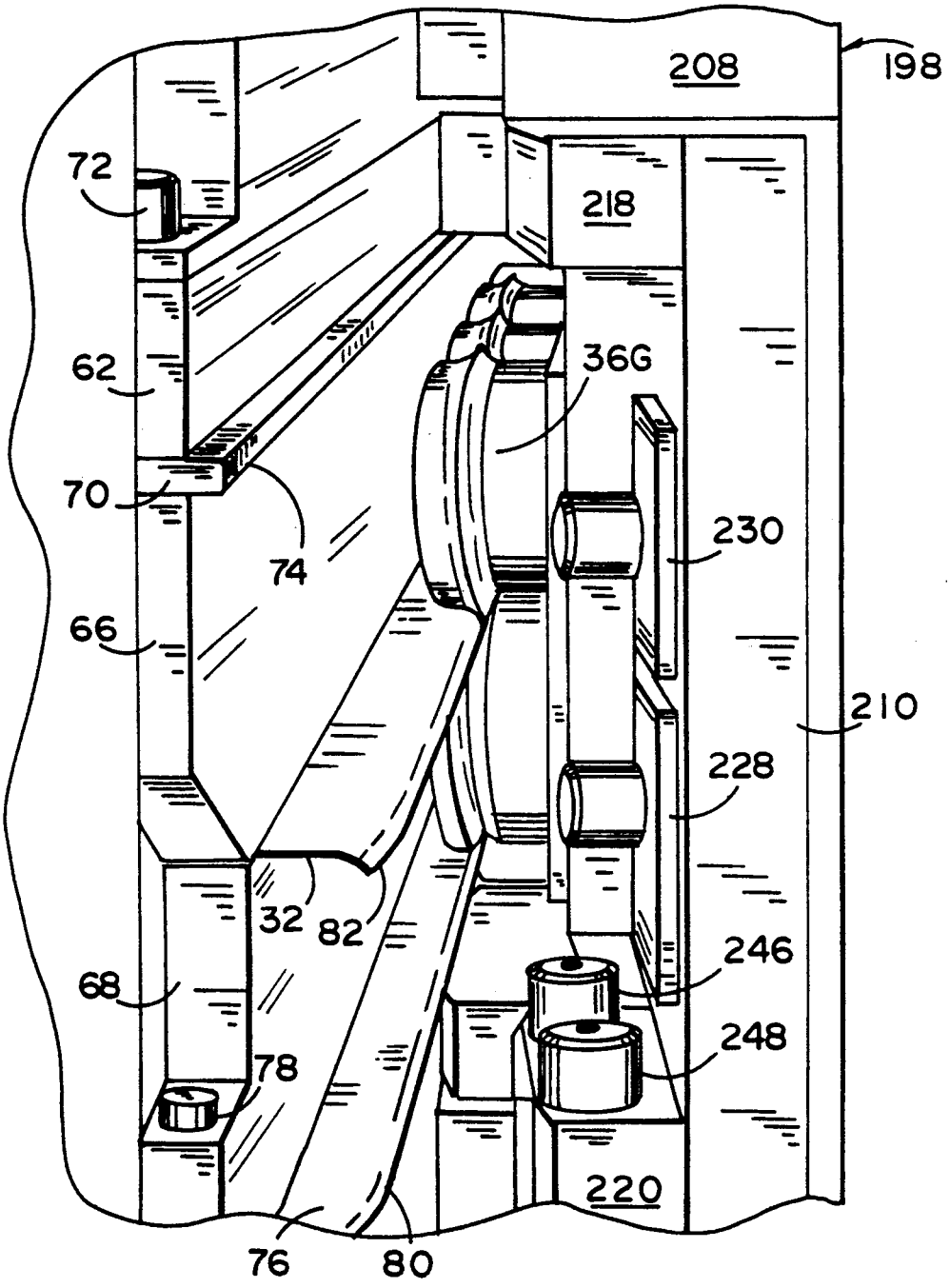
FIG. 3 is an enlarged broken away perspective view of the shearing station as viewed from the right side with the shearing heads removed illustrative purposes.

Frame 22 (FIG. 1 and 2) is constructed to provide stable and level support for the components of machine 20. Adjustable foot pads 38 extend downwardly from frame 22 contracting floor surface 40 and are useful for leveling and anchoring frame 22 on floor surface 40. Welded to the top of frame 22 are upstanding webs 42 which support two parallel longitudinally extending guide rods or tracks 44. Guide rods 44 guide and support a fixture or jig carriage 46 which carries and aligns a blank carrying jig or fixture 48 and part 32 as it passes through blank central portion 24.

Jig carriage 46 ( FIG. 1, 1A, and 2) includes an elongated framework 52 which carries jig mounting member 54 having upper mounting surface 56 to which jig 4 attaches. Framework 52 includes laterally and downwardly extending leg members 58 on the lower ends of which are bearings 60. Bearings 60 slideably support jig carriage 46 on guide rods 44 as it translates longitudinally. The preferred embodiment shows four leg members 58 on each side of jig carriage 46, however, it is contemplated that a variety of guiding or alignment means and also weight supporting means could be used. Mounted under jig carriage 46 and between guide rods 44 is an elongated hydraulic cylinder 61 which attaches operably between jig framework 52 and machine frame 22. Cylinder 61 provides the force necessary to translate jig 48 longitudinally back and forth past heads 34 and 36A–36G.

Blank carrying jig 48 (FIG. 1, 1A, 2, 3 and 6) rests on mounting surface 56 of jig carriage 46 and includes top and bottom clamping members 62 and 64, respectively, which in turn clamp upper and lower intermediate members 66 and 68, respectively. An elongate forming cam 70 is clampingly retained between top clamping member 62 and upper intermediate member 66 by bolts 72 with forming cam edges 74 hanging outwardly therefrom. An elongate slitting cam 76 is clampingly retained between bottom clamping member 64 and lower intermediate member 68 by bolts 78 with slitting cam edges 80 hanging outwardly therefrom. Also, part blank 32 is clampingly held between upper and lower intermediate members 66 and 68 with the blank edges 82 handing outwardly therefrom. With jig 46 in a closed clamping position ready for processing, members 62, 64, 66, and 68 hold cams 70 and 76 and part blank 32 in a stationary position relative to each other.

Jig carriage 46 (FIG. 1, 1A, and 2) also includes overhead structure 92 for closingly clamping and also openingly unclamping blank carrying jig 48. Overhead structure 92 is supported by upright posts 88, 90 which are mounted to the front and rear of jig carriage 46. Mounted to the sides of posts 88, 90 are ramps 94 (only one of which is shown) which align with cams 70 and 76 and cooperate with cam followers to prevent posts 88, 90 from striking and damaging heads 34 and 36A–36G. Overhead structure 92 includes multiple vertical posts 96 welded between two horizontal rails 100 and 102 which create a rigid framework. Five air cylinders 104 attach to the top of lower rail 102 between rails 100 and 102, and include downwardly extending shafts 106 which attach to brackets 108 located along the top of top clamping member 62. Air cylinders 104 are generally uniformly spaced along rails 100 and 102 to provide a uniform lifting force and also alternatively apply a downward clamping force on top clamping member 62. Air control for air cylinders 104 is jumpered from cylinder to cylinder by lines 110 and 112 which extend parallel to rails 100 and 102. Along the rear of frame 22 is an upstanding post 114 which provides raised air drops 116 and 118 for air control of air cylinders 104. Air drops 116 and 118 are located high enough such that the connecting hoses 128 and 130 extending between air drops 116, 118 and jig assembly 30 are out of the way and do not tend to snag on components of machine 20 as jig 48 moves back and forth on machine 20.

A station support framework or structure 132 (FIG. 1) is centrally mounted to machine frame 22 and is positioned adjacent and laterally beside frame 22. Structure 132 is positioned on either side of machine frame 22 and is generally box-like in shape. Structure 132 extends upwardly above guide rods 44 and supports a table member 134 which is mounted to the top of structure 132. Table member 134 includes a flat upper surface 135 and provides structural support for the various components associated with the slitting station 136 and roll-forming stations 138A–138G on central portion 24. A keyway 140 (FIGS. 2 and 5) extends parallel to guide rods 44 in upper surface 135 and provides lateral anchoring of slitting and roll-forming stations 136 and 138A–138G. Table member 134 further provides a mounting surface for miscellaneous accessories and station controls such as air distribution manifold 144 which conveys control air through air lines 145 (FIG. 2) to air cylinder 188. Mounted to the outboard side of structure 132 (FIGS. 1 and 1A) is a machine control panel 146 which includes various station control switches 148.

Figure 4:
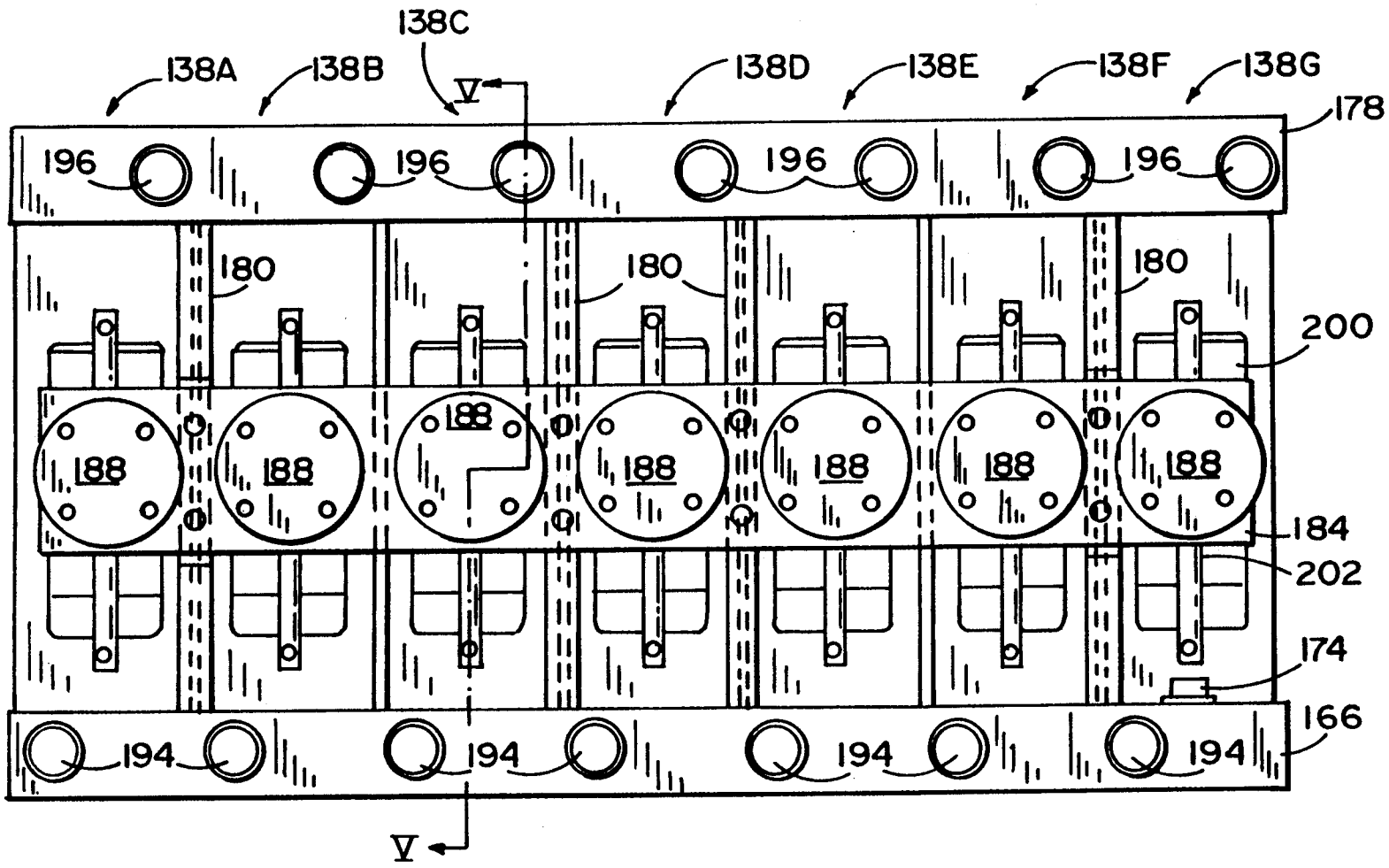
FIG. 4 is a side elevational view of the roll-forming stations.

Shearing station 136 and roll-forming stations 138A-138G (FIGS. 1A, 3-9) include similar components at each station except for the actual slitting heads 34, roll-forming heads 36A-36G and cam followers 238, 240, 246, and 248. Therefore, though the discussion focuses on roll-forming stations 138A-138G (FIGS. 4-6), similar components can be found on slitting station 136 except as specifically noted. Stations 138A-138G lie longitudinally centrally along machine 20. Stations 138A-138G (FIGS. 5 and 6) include opposing halves 158, 160 which are substantially mirror images of each other and are oriented opposingly on either side of a central plane or axis 162. Central plane 162 extends vertically upwardly and longitudinally along the length of machine 20. Central plane defines the longitudinal symmetrical center of machine and jig 48. Blank 32 and cams 70, 76 travel along central plane 162 as they transverse the length of machine 20 between side portion 26, 28 through central portion 24.

Opposing half 160 (and also 158) (FIG. 6) includes an upstanding stationary bearing plate 164 with lower laterally extending cross piece support member 166. Cross piece support member 166 is securely laterally positioned on table member 134 by key 168 which matingly anchors cross piece support member 166 to table member along keyway 142. Cross piece support member 134 and table member 134 also include multiple holes for attachment bolts 174, 176 to secure cross-piece support member 166 to table member. Stationary bearing plate 164 includes upper cross piece support member 178 which is vertically supported by vertical brace 180. Cross-piece support members 166 and 178 include upper and lower linear transverse bushings or bearings 180, 182. Bushings 180, 182 define axes 181, 183 which extend perpendicularly from central plane 162. On the outside of stationary bearing plate 164 is a transverse mounting bar 184 with multiple attachment holes 186 (FIG. 2) which allow for attachment of station air cylinders 188. Air cylinders 188 each include a horizontally extending shaft 190 which extends through a transverse hole 192 in mounting bar 184 and inwardly a distance therefrom. Slideably mounted within bushings 180, 182 are upper and lower horizontal slideable guide shafts 194, 196.

Figure 5:
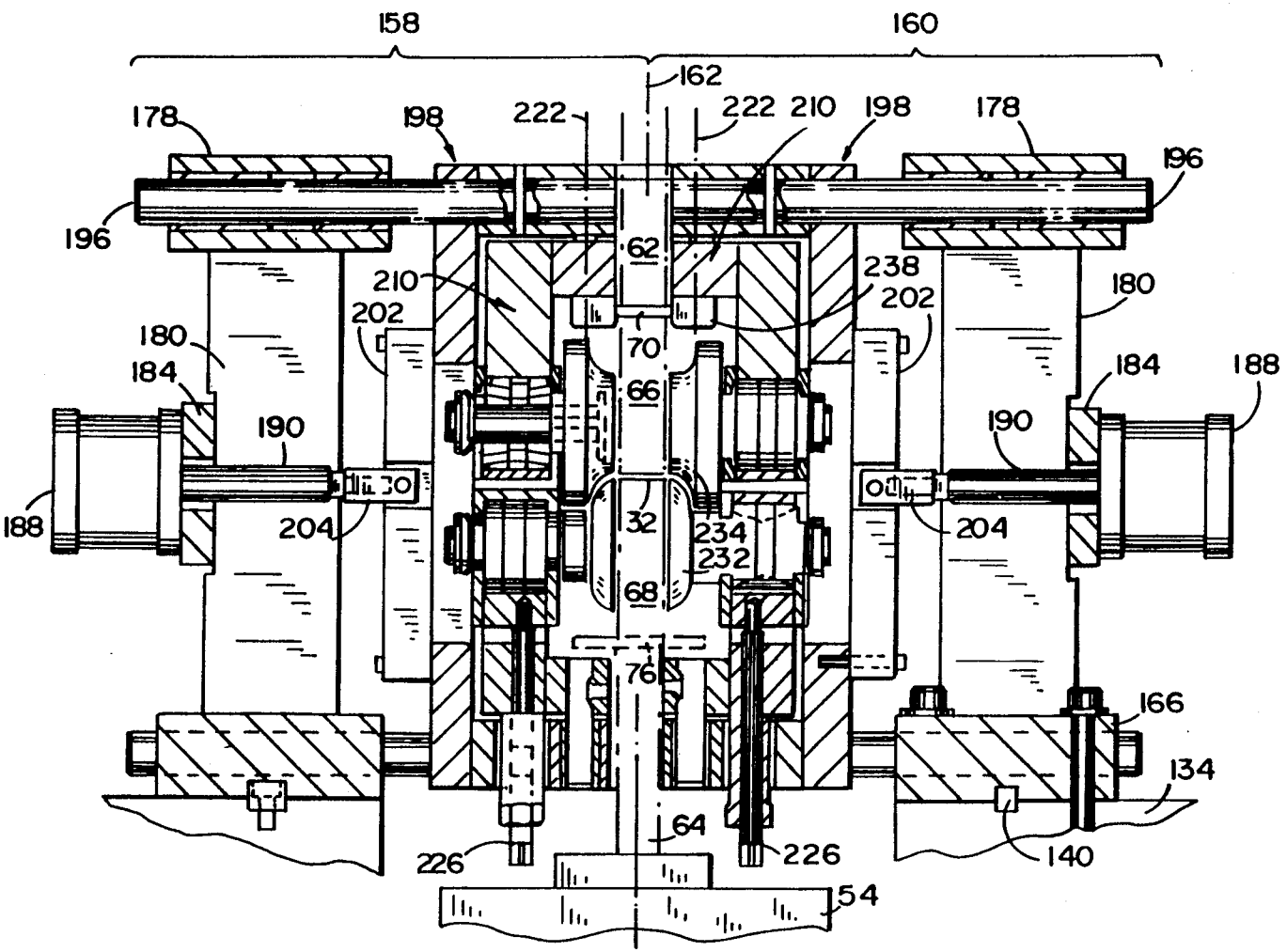
FIG. 5 is a cross-sectional view taken through lines V—V in FIG. 4.

Extending between and fixedly secured to shafts 194, 196 (FIG. 5) is a linearly adjustable bearing plate 198. Bearing plate 198 includes a centrally positioned rectangular opening 200. Opening 200 provides clearance for head bearings 228, 230 as best shown in FIG. 5. An elongated standoff 202 attached to the outside of linearly adjusting bearing plate 192 by bolts 199 and positioned between linearly adjustable bearing plate 198 and stationary bearing plate 164. Standoff 202 attaches to the inner end of air cylinder shaft 190 by bracket 204 forming a biasing mechanism thereby allowing air cylinder 188 to exert inward forces on standoff 202 causing linearly adjustable bearing plate 198 to slideable move inwardly toward central plane 162 along with slideable guide shafts 194, 196 thus presenting upper and lower heads 232, 234 in a ready-to-use position. This movement is illustrated by distance "D" in FIG. 7. Air cylinders 188 can also be used to retract linearly adjustable bearing plate 198 outwardly thereby withdrawing upper and lower heads 234, 236 to a storage or non-use position. Plate 198 further includes upper and lower extensions 206 and 208 which extend inwardly around guide shafts 194, 196 and provide a platform for pivotally adjustable bearing plate 210.

Figure 7:
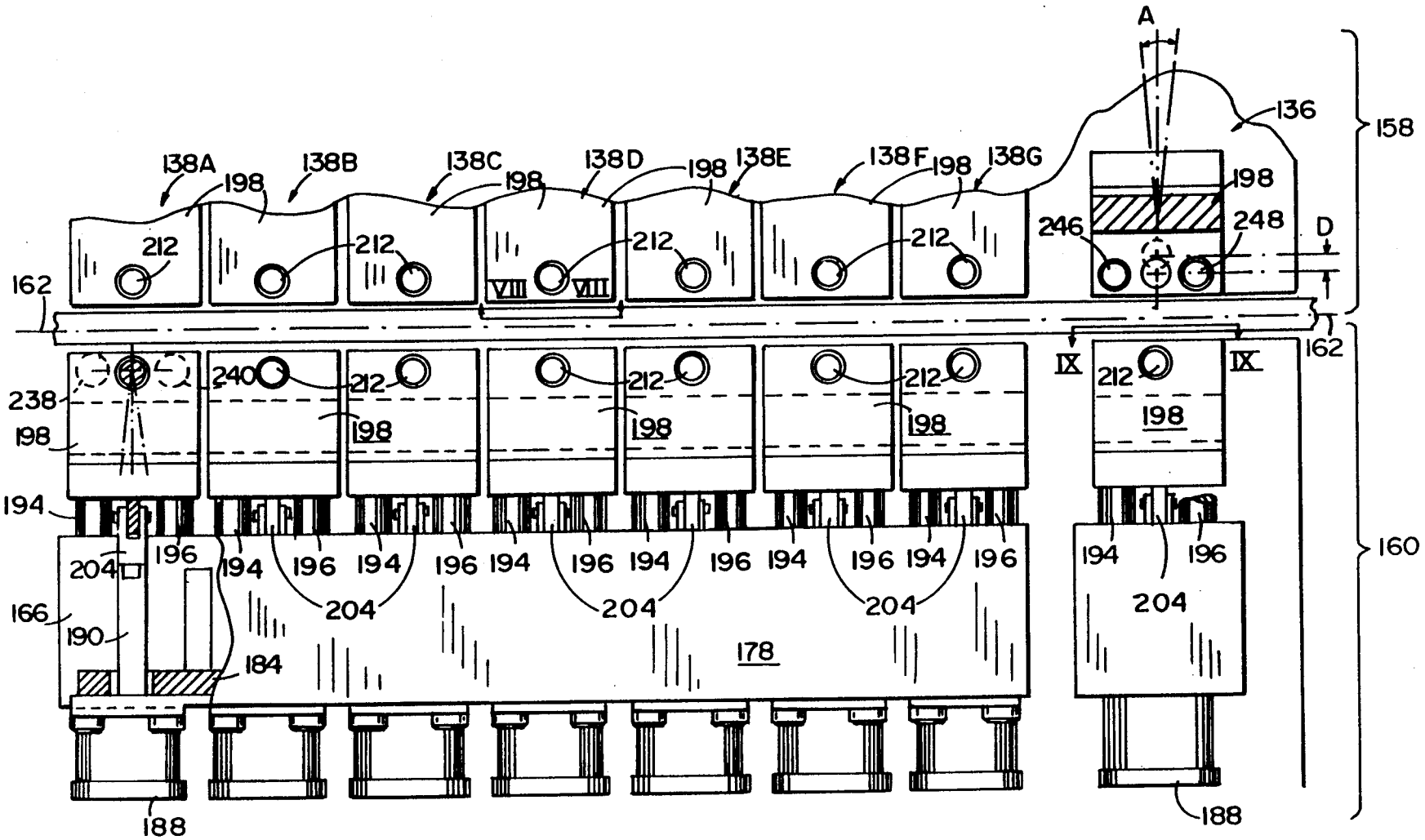
FIG. 7 is a top view of the forming and slitting stations with part of the slitting station broken away to better show the movement of components therein and part of the outermost forming station broken away to show attachment of an air cylinder to components therein.
Figure 10:
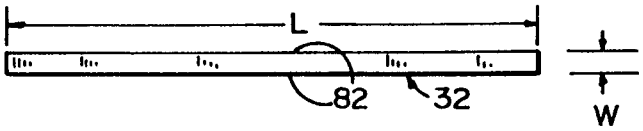
FIG. 10 is a schematic of a part blank.
Figure 11:
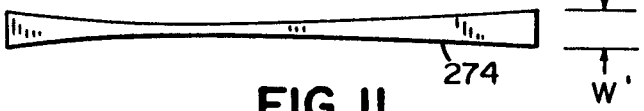
FIG. 11 is a schematic of a slit blank.
Figure 12:
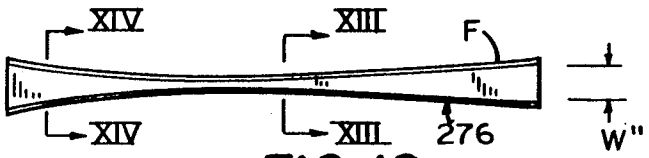
FIG. 12 is a schematic of a formed part.
Figure 13:
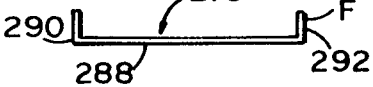
FIG. 13 is a cross-section taken through lines XIII—XIII in FIG. 12.
Figure 14:
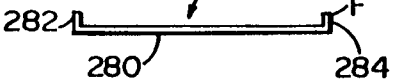
FIG. 14 is a cross-section taken through lines XIV—XIV in FIG. 12.
Figure 9:
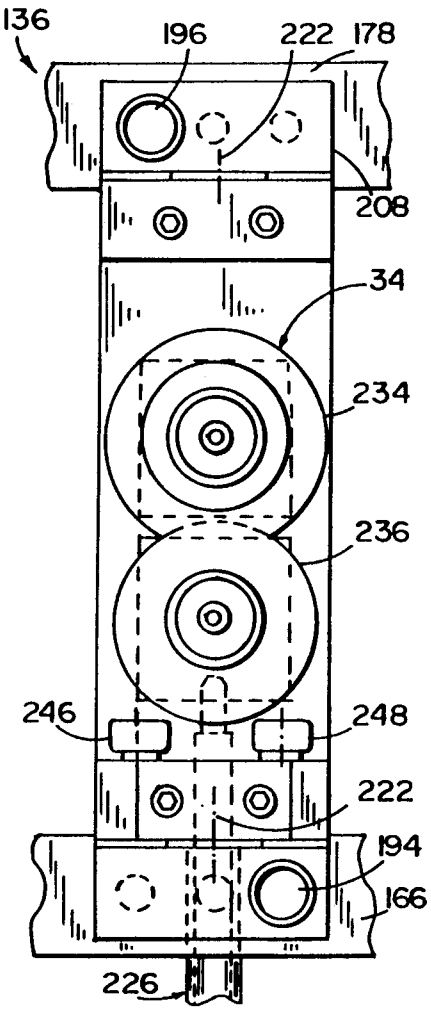
FIG. 9 is a side elevational view taken in the direction shown by lines IX—IX in FIG. 7.

A pivotally adjustable bearing plate 210 (FIG. 5) is attached to linearly adjustable bearing plate 198 by upper and lower pivot pins 212, 214, respectively. Pivotally adjustable bearing plate 210 includes a head bearing support member 216 and pivot pin holding members 218 and 220. Upper pivot pin 212 extends upwardly from pivot pin holding member 218 of pivotally adjustable bearing plate 210 and rotatably into upper extension 206 of linearly adjusting bearing plate 198 thus defining a vertical axis of rotation 222. Correspondingly, lower pivotal attachment pin 214 extends downwardly from pivot pin holding member 220 of pivotal adjustable bearing plate 198 and rotatably into lower extension 208 of linear adjustable bearing plate 198. Pins 212, 214 cooperate to allow pivotaly adjustable bearing plate 210 to pivot an angle "A" as illustrated in FIG. 7. Lower pivot pin holding member 220 includes an opening 224 which provides clearance for downwardly extending lower bearing adjuster 226 as described below.

Mounted transversely within pivotally adjusted bearing plate 210 are upper and lower head bearings 228, 230. Bearings 228, 230 are designed to carry mating sets of roll-forming (or slitting) heads including an upper head 232 and the lower head 234. In the illustrated example, heads 232, 234 are roll-forming heads for forming a flange on blank 32. Bearings 228, 230 are designed to withstand linear and rotational forces as blank 32 is formed between heads 232, 234 as blank 32 translates along central plane 162 of machine 20. Bearings 232, 234 are designed to be spaced a predetermined distance apart, thus allowing them to cooperatively form a path 236 for blank 32. Lower head bearing 230 is slideably mounted for vertically adjustable movement in head bearing support member 216 by adjuster 226 which extends upwardly through head bearing support member 216 into lower head bearing 230 thereby permitting an operator to adjustably set the thickness of path 236 for blank 32. Bearings 228, 230, as shown, are free-wheeling, but it is contemplated that heads 34, 36A-36G could be powered for rotational movement.

Figure 8:
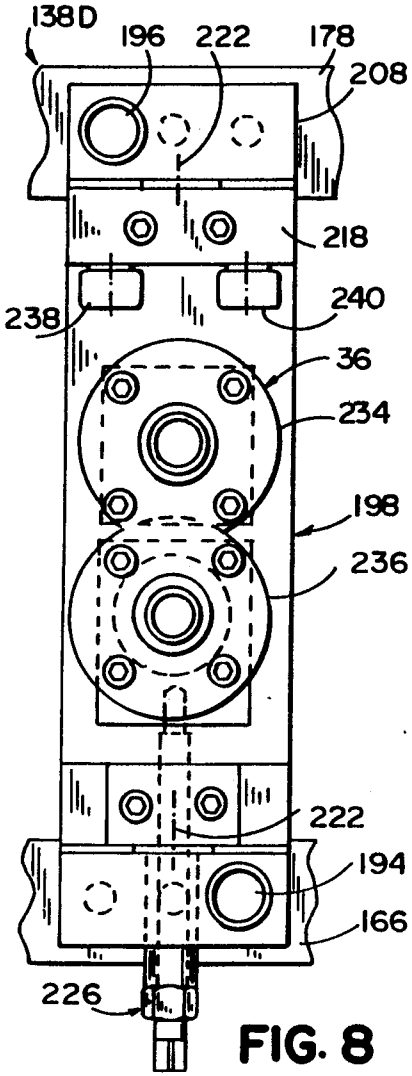
FIG. 8 is a side elevational view taken in the direction shown by lines VIII—VIII in FIG. 7.

In the roll-forming station 138D illustrated in FIG. 8 (typical for stations 138A-138G illustrated in FIGS. 3-8), two cam followers 238, 240 are rotationally mounted to the bottom of upper holding member 218. Cam followers 238, 240 (FIG. 6) are positioned to correspond in height to forming cam edge 74 of forming cam 70 as it is held by jig 48. Thus, cam followers 238, 240 engage forming cam 70 as jig 48 traverses along central plane 162. Cam followers 238, 240 follow the contoured side edges 74 of forming cam 70, thus vertically rotating pivotally adjustable bearing plate 210 about vertical axis 222 (and about pivot pins 212, 214). Simultaneously, cam followers 238, 240 also orient linearly adjusting bearing plate 198 slideably laterally on stationary bearing plate 164 on guide shafts 194, 196. More specifically, forming cam 70 forces cam followers 238, 240 outwardly, thereby forcing linearly adjustable bearing plate 164 outwardly toward stationary bearing plate 164 and against the inward force of air cylinders 188 acting on standoff 202. As pivotally adjustable bearing plate 210 is vertically rotated (FIG. 7), the orientation of the axes of rotation 242, 244 for heads 36A-36G

(and 34) changes with respect to central plane 162 causing heads 36A–36G (and 34) to walk outwardly (or inwardly) on blank 32. This allows machine 20 to readily form non-uniform flanges on blank 32 (as well as form a non-uniform width during slitting).

An arrangement similar to that for roll-forming stations 138A–138G is used for controlling the pivotal and lateral orientation of slitting heads 34 on slitting station 136. However, it is desirable to have separate and independent control for the slitting heads 34. To accomplish this, a second set of cam followers 246, 248 (FIG. 9) are attached below slitting heads 34 to a position on the upper side of lower holding member 220 on pivotally adjustable bearing plate 210. Shear cam followers 246, 248 are horizontally positioned to engage slitting cam 76 as jig 48 traverses through slitting station 136 on machine 20. The action of shear cam followers 246, 248 are similar to roll-forming cam followers 238, 240 as far as orienting heads rollers 34 both vertically rotationally and laterally with respect to blank 32.

Figure 16:
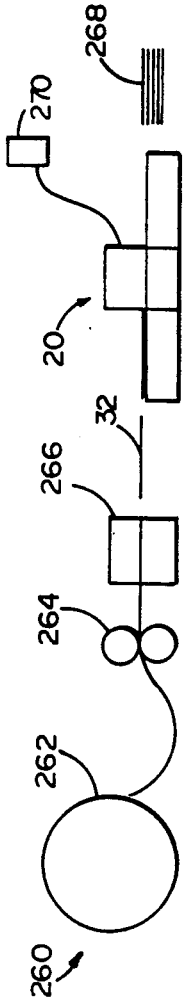
FIG. 16 is schematic of a first press arrangement.
Figure 17:
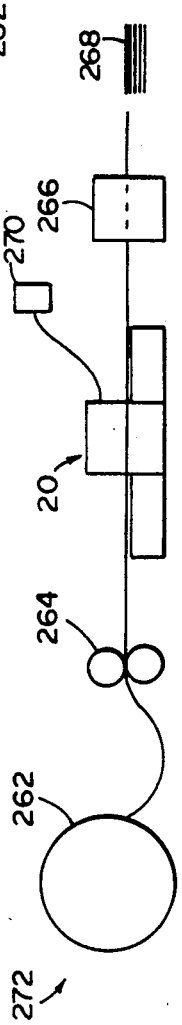
FIG. 17 is a schematic of a second press arrangement.
Figure 6:
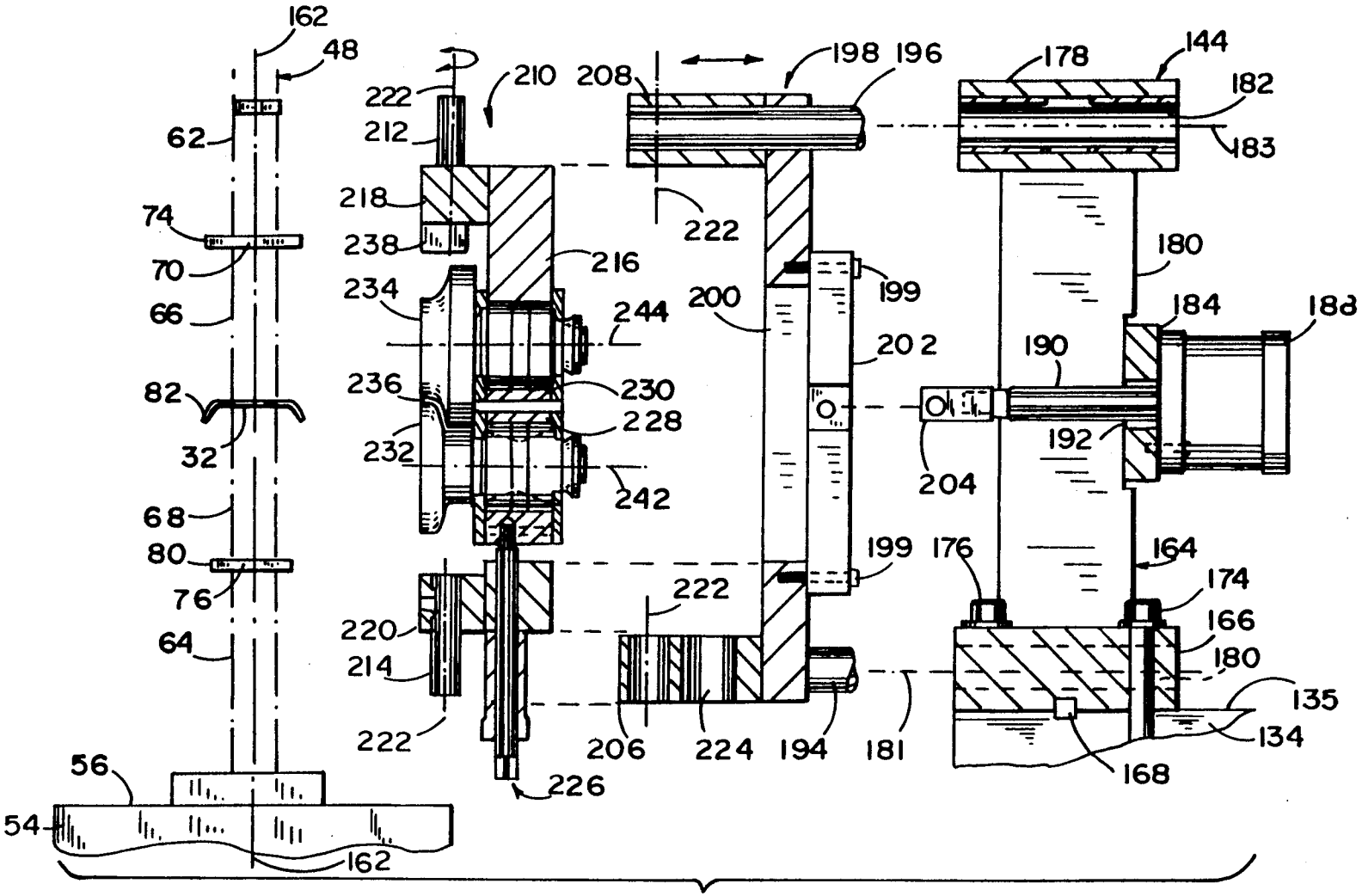
FIG. 6 is a partially exploded view of a symmetrical half of the assembly shown in FIG. 5.

Machine 20 can be utilized in various processes embodying the method of the present invention, two of which are illustrated in FIGS. 16 and 17. In a first arrangement 260 (FIG. 16) a coil of metal strip stock 262 is uncoiled into a substantially flat condition by straightening rollers 264 and is then cut into segments at cutting station 266 to define a part blank 32. Part blanks 32 are then passed through machine 20. Finished parts are then stacked in stack 268 ready for further processing as may be required. It is contemplated that slitting heads 34 and roll-forming heads 36A–36G could be controlled by a remote controller 270 as illustrated in FIG. 16 or by the cams 70 and 76 in cooperation with jig 30 as discussed above. It is contemplated that controller 270 could be pneumatic, hydraulic, or electromechanical, but would be constructed to be programmable and would control the vertical rotation of pivotally adjustable bearing plate 210 and/or linearly adjustable bearing plate 198 (FIG. 6). For example, the vertical rotation and linear position could be controlled by cylinders positioned similar to air cylinders 188 but operably connected to pivotally adjustable bearing plate 210 and/or linearly adjustable bearing plate 198.

In a second arrangement 272 (FIG. 17), the position of machine 20 and cutting station 266 in the arrangement are reversed, with stock being continuously fed into machine 20. In this arrangement, it is contemplated that slitting heads 34 and roll-forming heads 36A–36G are driven by a remote controller 270′ which controls the vertical rotation of the pivotally adjustable bearing plate 210 and linearly adjustable bearing plate 198 as discussed above.

Figure 15:
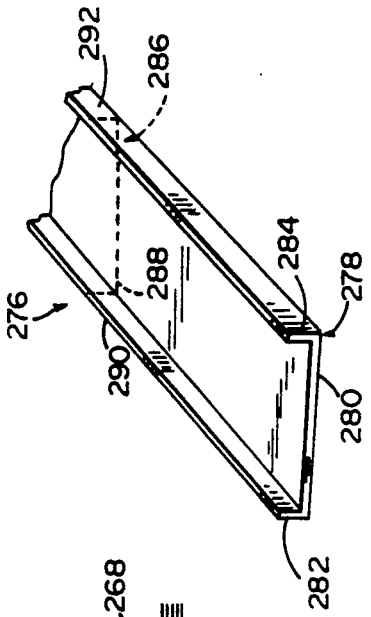
FIG. 15 is a fragmentary perspective view of a formed three-dimensional part.

The various forms of part blank 32 as it progresses through machine 20 are illustrated in FIGS. 10–15. Part blank 32 (FIG. 10) is a substantially flat segment cut from uncoiled and straightened strip stock 262. Part blank 32 has a consistent width (W) with edges 82 and length "L". Part blank 32 is mounted on jig 30 and has edges 82 sheared on a first pass past slitting heads 34 to form strip blank 274 (FIG. 11) with opposite sides edges (W′) which are non-uniform and are symmetrical with respect to each other and to central plane 162. Slit blank 274 is carried by jig 48 past roll-forming heads on a second pass, during which a three-dimensional part 276 (FIGS. 12–15) with complex shape is formed having width (W″) and non-uniform flanges "F". Part 276 is best illustrated in FIG. 15 wherein an end 278 having a width 280 and small flanges 282, 284 and a narrowed intermediate section 286 having a smaller width 288 and larger flanges 290, 292 is shown. It is specifically noted that dimensionally, the distance across width 280 plus flanges 282 and 284 does not necessarily equal the distance across width 288 plus flanges 290 and 292.

The illustrated embodiment of part 276 (FIGS. 12 and 15) is useful as a shell for making such items as downhill snow skis. By use of machine 20, parts 276 can be made with a tip and heel, and also out of high strength materials as are required for skis. Further, sharp bends can be accurately made in forming the flanges. Still further, various widths and bending strengths can be incorporated into parts 276 along their length, thereby customizing the skis for skiers of various sizes, weights, abilities, and types of skiing. It is contemplated that parts 276 could also be used in other applications such as, for example, automotive trim.

OPERATION

Having described our apparatus and method for forming a slit blank 274 having non-uniform but symmetrical edges (W′), and further roll-forming slit blank 274 into a three-dimensional part 276 having a non-uniform width (W″) and non-uniform flanges "F", the operation of this invention should become evident Briefly, the operation begins by providing machine 20 and jig 48 in an arrangement such as 260 (FIG. 16) as described above. Strip stock is uncoiled from coil 262 and straightened by rollers 264. Cutting station 266 then cuts a part blank 32 from the flatened segment. In arrangement 260, jig 48 is assembled in sandwich-like fashion on jig carriage 46 in the following order from top to bottom: top clamping member 62, forming cam 70, upper intermediate member 66, lower intermediate member 68, slitting cam 76, and bottom clamping member 64. Blank 32 is then inserted between intermediate members 66 and 68 and air cylinders 104 are activated causing shafts 106 to extend downwardly compressing jig 48. In this position the edges of cams 70, 76 and blank 32 hang out laterally from jig 48. Air cylinders 188 are actuated on slitting station 136 causing associated shafts 190 to force linearly adjustable bearing plate 198 to move inwardly, thus positioning slitting heads 34 in a ready position for slitting edges 82 of blank 32. Simultaneously, lateral air cylinders 188 of forming station 138A–138G move linearly adjustable bearing plates 198 of roll-forming stations 138A–138G outwardly removing roll-forming heads 36A–36G from the path of travel of blank 32.

Hydraulic cylinder 61 is then actuated causing jig 48 and specifically blank 32 to translate along central plane 162. This brings edges 82 of blank 32 into engagement with slitting heads 34. Slitter cam followers 246, 248 engage the contoured edges 80 of slitting cam 76, thus pivotally and laterally linearly positioning slitting heads 34 with respect to blank 32. As slitting heads 34 are pivotally oriented, they tend to walk outwardly (or inwardly) on blank 32 slitting a symmetrical but non-uniform width (W′) on blank 32 to form slit blank 274.

After forming slit blank 274, lateral air cylinders 104 draw linearly adjustable bearing plate 198 of slitting station 136 outwardly and cause linearly adjustable bearing plate 198 of roll-forming station 138A–138G to move inwardly, thus positioning roll-forming heads 36A–36G to engage the edges of slit blank 274. Jig 48 roll forming is then translated along central plane 162 such that roll-forming cam followers 238, 240 engage forming cam 70, thus pivotally and laterally orienting and positioning pivotally adjustable bearing plate 156 and linearly adjustable bearing plate 198 of roll-forming stations 138A–138G. Forming heads 36A–36G are thus oriented to walk inwardly (or outwardly) on slit blank 274 as desired to form flanges "F".

A Complex three-dimensional part 276 is thereby formed. Part 276 can be released from jig 48 by reversing the procedure for fixing blank 32 within jig 48. Generally, compressed air is reversibly directed to air cylinders 104 so as to retract shafts 106 and remove the compressive force on jig 48. Upper and lower intermediate members 66, 68 are thereby separated and part 276 can be removed and a new blank 32 placed therein.

It is contemplated that the the slitting and roll-forming operations by stations 136 and 138A–138G could be performed in a number of different sequences such as: 1) simultaneously on a single pass, 2) successively on separate passes in opposite directions, or 3) successively on separate passes in the same direction. This choice of direction would depend upon the user preference. In the preferred embodiment, it is contemplated that the slitting will be done in a first direction on a first pass, and the roll-forming will be done in a second direction on a second pass. This allows an operator(s) to load blanks 32 and unload parts 276 on jig 48 in a single location. It also minimizes the force which must be exerted by cylinder 61 at single time, since only the shearing heads 34 or only the roll-forming heads 36 are engaged at a single time. Further, this also maximizes the use of maching time since blank 32 is being formed in some way every time jig assembly is moved. Further, this sequence results in the least amount of wasted machine motion, thereby reducing unnecessary wear on bearings 60 (and machine 20 in general).

It should be evident from the above description that we have provided a slitting and roll-forming method and machine for forming elongated parts having a non-uniform width and non-uniform flanges thereon. This is made possible by the unique vertically rotatable and laterally adjustable bearing plates and the other cooperation components of this invention as have been described.

Having described the invention, it should be understood that although a preferred embodiment has been disclosed herein, other modifications and embodiments can be utilized without departing from the spirit of this invention. Therefore, this invention should not be limited to only the embodiment illustrated, which has been described as an example only.

The embodiments of the invention in which an exclusive property or privilege is claimed are defined as follows:

1. A method for making three-dimensional metal parts with complex shapes, comprising:

providing a coil of metal strip stock having a substantially uniform width;

uncoiling a segment of the strip stock from the coil, and straightening the same to a substantially flat condition;

cutting from the flattened strip stock segment a predetermined length of the same to define a part blank;

providing a jig with a central, longitudinal axis, and clamp means located on the jig for securely, yet removably retaining the part blank therein, said clamp means including top and bottom elongated clamping members;

positioning the part blank generally centrally in the jig in alignment with said central longitudinal axis of said jig and between the top and bottom clamping members, such that opposite sides of the part blank extend outwardly from the jig to facilitate forming the same;

selecting at least two elongated cams and positioning same between the top and bottom clamping members;

clamping said at least two elongated cams and the part blank to said jig between said top and bottom clamping members in a sandwich-like arrangement so that same are held continuously along said predetermined length by use of said clamp means;

simultaneously slitting the opposite sides of the jig mounted part blank to form a slit blank with a predetermined non-uniform width, and opposite side edges thereof disposed precisely symmetrical to the central longitudinal axis of the jig, with one of said at least two cams determining said predetermined non-uniform width; and simultaneously roll-forming the opposite sides of the slit blank to create a pair of upstanding flanges thereon disposed at selected angles with respect to the rest of the part blank with another of said at least two cams determining the complex three-dimensional shape, whereby complex, three-dimensional shapes can be accurately and efficiently formed.

2. A method as set forth in claim 1, wherein said roll-forming comprises:

positioning first and second roll-forming heads adjacent the opposite side edges of the slit blank;

translating said slit blank longitudinally with respect to said roll-forming heads, and simultaneously rotating said roll-forming heads about a generally vertical axis with respect to the central longitudinal axis of the jig to assist in forming the flanges with a non-uniform height.

3. A method as set forth in claim 2 including:

providing a cam follower operably connected to said roll-forming heads; and controlling the position of said roll-forming heads by interaction of said one of said elongated cams and said cam follower as said slit blank is translated past said roll-forming heads.

4. A method as set forth in claim 3 including:

pneumatically biasing said roll-forming heads toward said jig by use of a biasing mechanism including pneumatic cylinders; and controlling the rotation about the vertical axis of and lateral position of said roll-forming heads from said central longitudinal axis of said jig by forcing said roll-forming heads outwardly against the biasing force of said biasing mechanism.

5. A method as set forth in claim 2 including:

providing a carriage for carrying the jig; and translating said jig and slit blank past said roll-forming heads by use of said carriage.

6. A method as set forth in claim 1 wherein said roll-forming comprises:

providing a cam follower;

positioning first and second roll-forming heads adjacent the opposite side edges of the slit blank, said cam follower being operably connected to said first and second roll-forming heads;

translating said slit blank longitudinally with respect to said roll-forming heads, and simultaneously controlling the position of said roll-forming heads with respect to the central longitudinal axis of the jig by interaction of said one of said cams and said cam follower to assist in forming the upstanding flanges with a non-uniform height.

7. A method as set forth in claim 1, wherein said slitting comprises:

positioning first and second slitting heads adjacent the opposite side edges of the part blank;

translating said part blank longitudinally with respect to said slitting heads, and simultaneously rotating said slitting heads about a generally vertical axis with respect to the central longitudinal axis of the jig to assist in slitting the opposite sides of the part blank to form a slit blank having a predetermined shape with a non-uniform width.

8. A method as set forth in claim 7 including:

providing a cam follower operably connected to said slitting heads; and controlling the position of said slitting heads by interaction of said another of said elongated cams and said cam follower as said part blank is translated past said slitting heads.

9. A method as defined in claim 8 including:

pneumatically biasing said slitting heads toward said jig by use of a biasing mechanism including pneumatic cylinders; and controlling the rotation about the vertical axis of and lateral position of said slitting heads from said central longitudinal axis of said jig by forcing said slitting heads outwardly against the biasing force of said biasing mechanism.

10. A method as set forth in claim 7 including:

providing a carriage for carrying the jig; and translating said jig and part blank past said slitting heads by use of said carriage.

11. A method as set forth in claim 1, wherein said slitting comprises:

providing a cam follower;

positioning first and second slitting heads adjacent the opposite side edges of the part blank, said cam follower being operably connected to said first and second slitting heads;

translating said part blank longitudinally with respect to said slitting heads, and simultaneously controlling the position of said slitting heads with respect to the central longitudinal axis of the jig by interaction of said another of said cams and said cam follower to assist in slitting the opposite sides of the part blank to form a slit blank having a predetermined shape with a non-uniform width.

12. A method as set forth in claim 1 wherein said clamp means includes one or more cylinders, and said step of clamping the part blank includes actuating said cylinders.

13. A method as set forth in claim 1 wherein said jig includes elongated top and bottom intermediate clamping members, and said step or clamping the part blank includes pressing said top and bottom intermediate clamping members together against the part blank.

14. A method as set forth in claim 3 wherein said jig includes elongated top and bottom intermediate clamping members, and said step of clamping the part blank includes pressing said top and bottom intermediate clamping members together against the part blank.

15. A method as set forth in claim 8 wherein said jig includes elongated top and bottom intermediate clamping members, and said step of clamping the part blank includes pressing said top and bottom intermediate clamping members together against the part blank.

16. A method for roll-forming three-dimensional metal parts with complex shapes, comprising:

providing a jig with a central, longitudinal axis, and clamp means located on the jig for securely, yet removably retaining a blank therein, said clamps means including top and bottom clamping members;

positioning the blank generally centrally in the the jig in alignment with said central longitudinal axis of said jig and between the top and bottom clamping members, such that opposite sides of the blank extend outwardly from the jig to facilitate forming the same;

selecting at least one elongated cam and positioning same between the top and bottom clamping members;

clamping the part blank and said at least one elongated cam and to said jig between the top and bottom members in a sandwich-like arrangement so that same are held continuously along said predetermined length by use of said clamp means;

positioning at least first and second roll-forming heads adjacent the opposite side edges of the blank;

translating said jig mounted blank longitudinally with respect to said roll-forming heads;

simultaneously roll-forming the opposite side of the jig mounted blank to create a pair of upstanding flanges thereon disposed at selected angles with respect to the rest of the blank with said at least one cam determining said complex three-dimensional shape; and simultaneously rotating about a generally vertical axis and laterally converging and diverging said roll-forming heads with respect to the central longitudinal axis of the jig to assist in forming the flanges with a non-uniform height whereby complex, three-dimensional shapes can be accurately and efficiently formed.

17. A method as set forth in claim 16 wherein said clamp means includes one or more cylinders, and said step of clamping the part blank includes actuating said cylinders.

18. A method as set forth in claim 16 including providing said jig with elongated top and bottom intermediate clamping members, and wherein said step of clamping the part blank includes pressing said top and bottom intermediate clamping members together against the part blank.

19. A method as set forth in claim 18 including providing a cam follower operably connected to said roll-forming heads, and controlling the position of said roll-forming heads by interaction of said elongated cam and said cam follower as said part blank is translated past said roll-forming heads.

20. A method for making two dimensional elongated metal parts having non-uniform symmetrical widths comprising:

providing a jig with a central, longitudinal axis, and clamp means located on the jig for securely, yet removably retaining a part blank therein, said clamp means including top and bottom clamping members;

positioning the part blank generally centrally in the jig in alignment with said central longitudinal axis of said jig and between the top and bottom clamping members, such that opposite sides of the part blank extend outwardly from the jig to facilitate slitting the same;

selecting at least one elongated cam and positioning same between the top and bottom clamping members;

clamping the part blank to said jig and said at least one cam between the top and bottom members in a sandwich-like arrangement so that same are held continuously along said predetermined length by use of said clamp means;

positioning first and second slitting heads adjacent the opposite side edges of the part blank; and translating said jig mounted part blank longitudinally with respect to said slitting heads;

simultaneously slitting the opposite sides of the jig mounted part blank to form a slit blank with a predetermined non-uniform width having opposite side edges thereof disposed precisely symmetrical to the central longitudinal axis of the jig with said at least one cam determining said predetermined non-uniform width; and simultaneously rotating about a generally vertical axis and laterally converging and diverging said slitting heads with respect to the central longitudinal axis of the jig to assist in slitting the opposite side of the part blank to form the slit blank.

21. A method as set forth in claim 20 wherein said clamp means includes one or more cylinders, and said step of clamping the part blank includes actuating said cylinders.

22. A method as set forth in claim 20 including providing said jig with elongated top and bottom intermediate clamping members, and wherein said step of clamping the part blank includes pressing said top and bottom intermediate clamping members together against the part blank.

23. A method as set forth in claim 22 including providing a cam follower operably connected to said slitting heads, and controlling the position of said slitting heads by interaction of said elongated cam and said cam follower as said part blank is translated past said slitting heads.

* * * * *